US006899031B2

(12) United States Patent
Hauck

(10) Patent No.: US 6,899,031 B2
(45) Date of Patent: May 31, 2005

(54) METHOD OF COMPENSATING FOR MISREGISTRATION DURING OPERATION OF A PRINTING PRESS

(75) Inventor: Axel Hauck, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 76 days.

(21) Appl. No.: 10/661,276

(22) Filed: Sep. 12, 2003

(65) Prior Publication Data

US 2004/0103810 A1 Jun. 3, 2004

(30) Foreign Application Priority Data

Sep. 13, 2002 (DE) ..... 102 42 549

(51) Int. Cl.[7] ..... B41F 1/34

(52) U.S. Cl. ..... 101/485; 101/211; 101/483; 101/484

(58) Field of Search ..... 101/171, 181, 101/211, 483–485

(56) References Cited

U.S. PATENT DOCUMENTS

| | | | | |
|---|---|---|---|---|
| 4,366,542 A | | 12/1982 | Anselrode | 364/469 |
| 5,327,826 A | | 7/1994 | Rodi | 101/181 |
| 6,050,192 A | | 4/2000 | Kipphan et al. | 101/232 |
| 6,354,214 B1 | * | 3/2002 | Tokiwa | 101/484 |
| 6,532,872 B2 | * | 3/2003 | Siegl et al. | 101/483 |
| 6,647,874 B1 | * | 11/2003 | Siegl et al. | 101/211 |
| 2003/0010242 A1 | | 1/2003 | Hauck | 101/485 |

FOREIGN PATENT DOCUMENTS

| | | | | |
|---|---|---|---|---|
| DE | 3027717 | | 2/1981 | |
| DE | 3933666 | | 4/1991 | |
| DE | 4218761 | | 12/1993 | |
| DE | 4218762 | | 12/1993 | |
| DE | 4321179 | | 1/1995 | |
| DE | 10132266 | | 1/2002 | |
| GB | 2170447 A | * | 8/1986 | B41F/33/02 |

* cited by examiner

*Primary Examiner*—Minh Chau
(74) *Attorney, Agent, or Firm*—Davidson, Davidson & Kappel, LLC

(57) ABSTRACT

A method is known of compensating for misregistration during operation of a printing press, in particular a sheet-fed offset printing press, in which misregistration occurring in the individual printing units are countered by register corrections. In order to provide a simple method to reduce misregisters after a pause in printing and in particular after washing of the rubber blanket cylinder, the pattern of the misregistration (PD) after a pause in printing is determined in a calibration phase over a sufficient number of sheets, data as a function of the pattern of the misregistration is stored in a memory unit (15) so that register correction values (Ki) may be determined and the register correction values are applied to the printing press upon restart after the pause in printing in order to compensate for the misregistration.

12 Claims, 3 Drawing Sheets

METHOD OF COMPENSATING FOR MISREGISTRATION DURING OPERATION OF A PRINTING PRESS

Priority to German Patent Application No. 102 42 549.3, filed Sep. 13, 2002 and hereby incorporated by reference herein, is claimed.

BACKGROUND INFORMATION

The present invention relates to a method of compensating for misregistration during operation of a printing press.

In achieving high printing quality on a printing unit, the positional accuracy of the color separations relative to one another is of paramount importance. This positional accuracy is defined by the register, i.e., by any misregistration. The register should be kept as constant as possible, which means in other words that misregistration should be avoided. Misalignment can be critical after a pause in printing and in particular after washing of the rubber blanket. It is particularly critical where the rubber blanket is washed frequently, for example when printing fluffing papers and in the case of relatively long critical print runs. The misalignment after a pause in printing may be several hundredths of a millimeter, depending on the type of press and the number of printing units. When printing is re-started, it can take up to several hundred sections until the misalignment has returned to the original steady-state value before the pause. It thus takes a very long time before the press operator reaches a good section. Misalignment is primarily caused by changes in the characteristics of the departure of the paper from the rubber blanket.

A method is known in an automatic registration measurement and control device from the Heidelberger Druckmaschinen company of Heidelberg, Germany, having the designation Autoregister CPC 42. In this device, registration marks are printed in each printing unit at the edges of the paper sheet, indicating the position of the color separation on the sheet. Making use of these printed registration marks, the misregistration of the individual colors respective to one another are determined and positioning commands are calculated therefrom in order to make the necessary register corrections. The corrections are then applied, thus compensating for the misregistration.

A further improved method of regulating the register in a sheet-fed rotary printing press when the print speed changes is known from German Patent Application No. 101 32 266 A1.

However, both compensation methods are complex in terms of regulation and hardware, and in addition the register shift after a pause in printing can only be corrected once the measurement system has determined the shift and passed the information to the control system.

Furthermore, it is generally conventional practice to correct misregistration by manual adjustment. However, this must be repeated after every pause in printing and in particular after every washing operation; there is no provision for automation.

BRIEF SUMMARY OF THE INVENTION

An object of the present invention is to provide a simple method of reducing misregistration after a pause in printing, and in particular after washing of the rubber blanket cylinder.

According to the present invention, in a calibration phase the pattern of misregistration after a pause in printing is determined over a sufficient number of sheets, data as a function of the pattern of the misregistration is then stored in a memory unit so that register correction values may be determined, and later in the press run the register correction values are applied to the printing press upon restart after a pause in order to compensate for the misregistration.

Different register correction values are used depending on whether the pause in printing does or does not involve washing the rubber blanket, because of the marked difference in misregistration which occurs in the two cases. The compensation control according to the present invention is rapid and simple.

In order to increase the accuracy of the compensation method, it is possible to arrange for the scatter in the data collected in the calibration phase, or different influencing variables, to be taken into account when the register correction values are established. Thus, different sets of register correction values for differing operating temperatures, paper and ink types, wetting agents, washing agents, subjects and print speeds may be stored in the memory unit and may be edited.

If the compensation for misregistration (PD) may be started with the first printed sheet after the pause in printing, the press operator reaches the first good section without any loss of time.

BRIEF SUMMARY OF THE DRAWINGS

An exemplary embodiment of the method according to the invention is described below.

DETAILED DESCRIPTION

Figure 1:
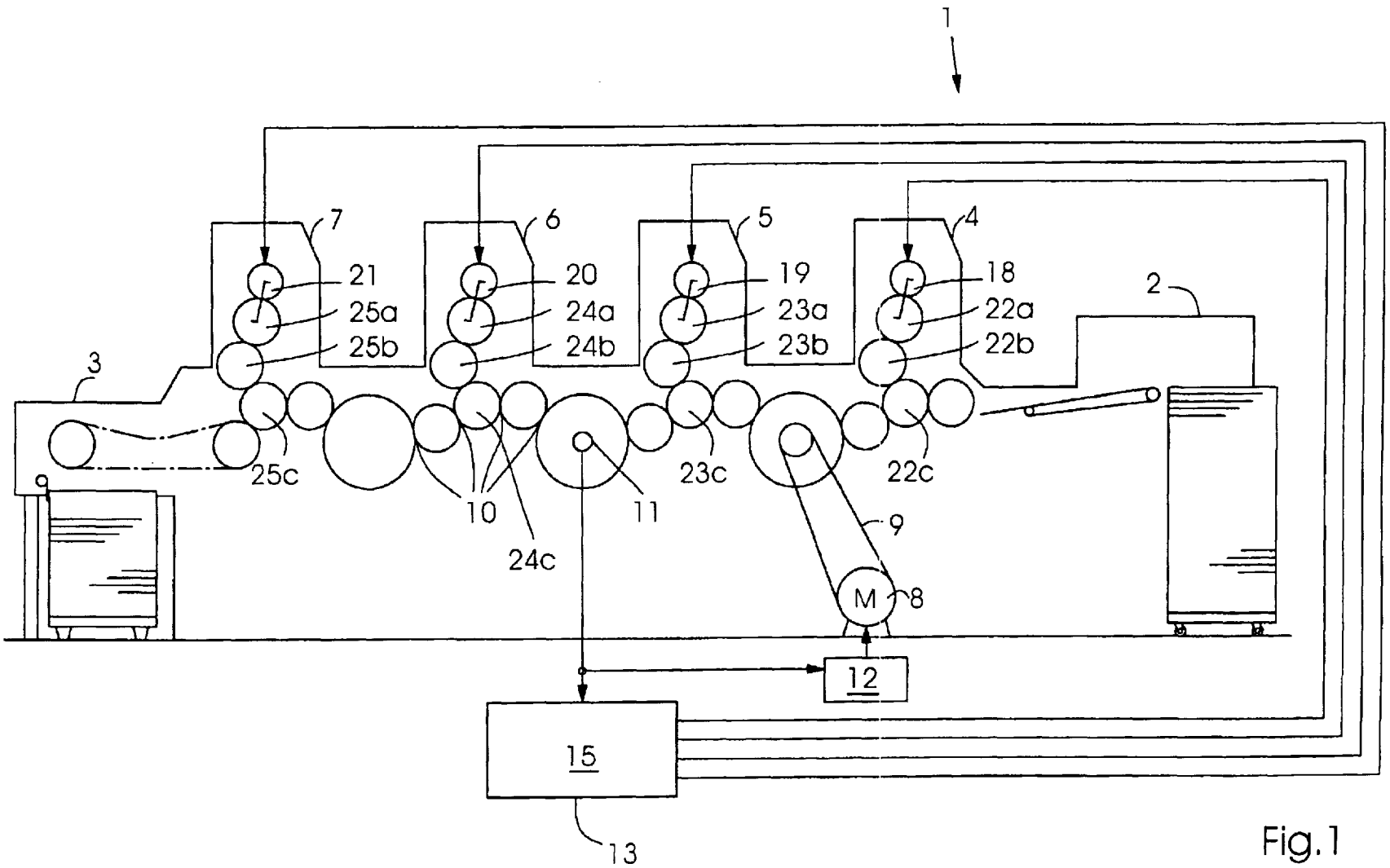
FIG. 1 shows a simplified schematic sketch of a sheet-fed offset printing press.

FIG. 1 shows a four-color sheet-fed offset printing press 1 with an in-feed 2 and an out-feed 3, and four printing units 4, 5, 6, 7 and a drive motor 8. By way of a belt 9 the motor drives a gear train 10, operating all printing units, and the in-feed and out-feed. The printing units have plate cylinders 22*a*, 23*a*, 24*a*, 25*a*, rubber blanket cylinders 22*b*, 23*b*, 24*b*, 25*b* and counterpressure cylinders 22*c*, 23*c*, 24*c*, 25*c*, which operate together in the known fashion. The printing speed is detected by a transducer 11, primarily for regulation purposes, and supplied to a motor regulator 12 which is linked to drive motor 8. The printing press has a controller 13 and a memory unit 15. By way of register adjustment motors 18, 19, 20, 21, register corrections, either circumferential or transverse, may be applied in each printing unit to the plate cylinders, under the control of controller 13.

Figure 2:
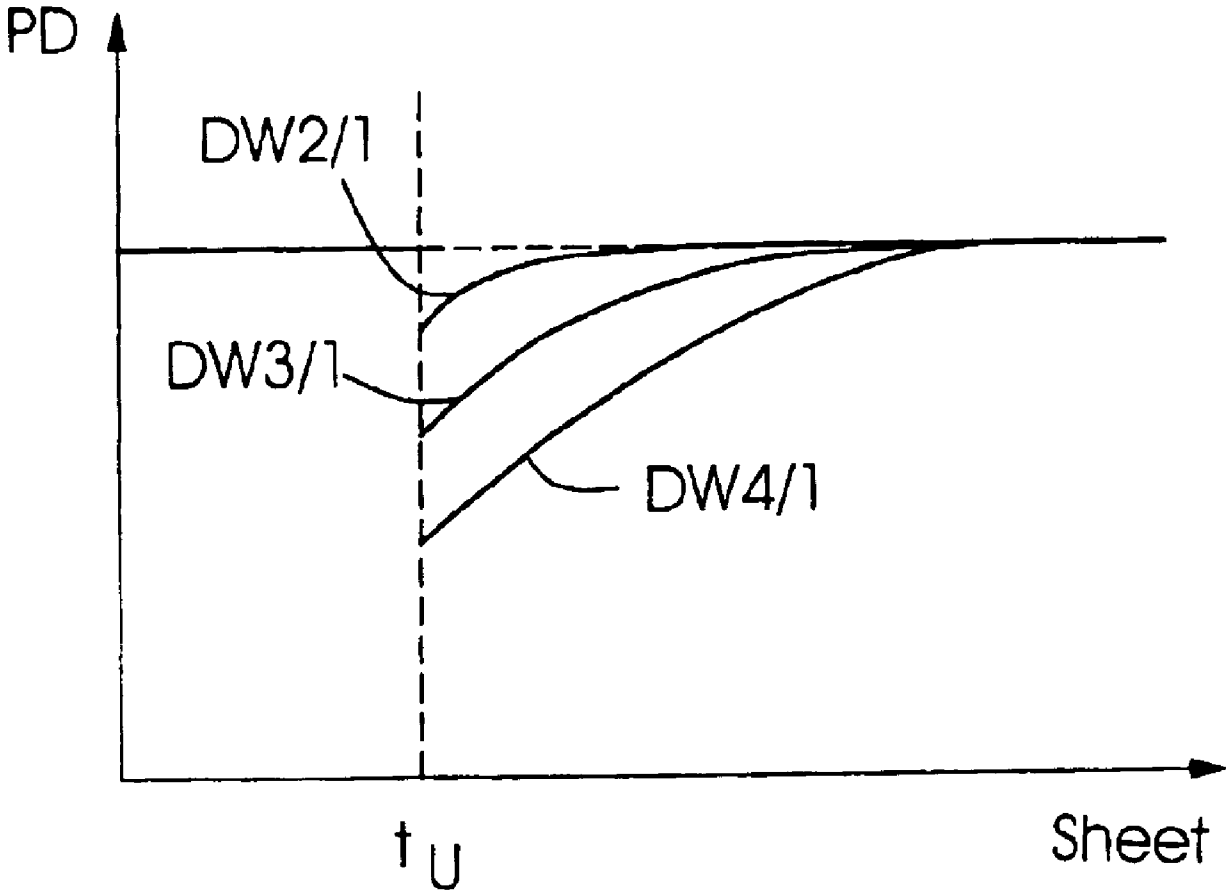
FIG. 2 shows in simplified form the pattern of the misregistration of the various printing units following a pause in printing.

FIG. 2 schematically shows the patterns of misregistration value (PD) DW2/1, DW3/1 and DW4/1 of individual printing units 5, 6, 7, in each case with reference to first printing unit 4. It can be seen that there is an increase in misregistration value (PD) with each of the second through fourth printing units 5, 6, 7. Initially the register is constant, in other words there is no misregistration. Then at time tU a pause occurs in the printing process with a washing operation on rubber blanket cylinders 22*b*, 23*b*, 24*b*, 25*b*. As a result of the washing operation there is a change in the force with which the sheet is drawn off or exits the rubber blanket. When drive motor 8 is restarted there is in addition a difference in torque between the printing units, resulting in the misregistration shown on axis PD. The register in some cases does not reach its original steady-state initial value until after several hundred sheets. The sheets which have been printed up to that point thus show register errors of varying degrees of severity.

Figure 3:
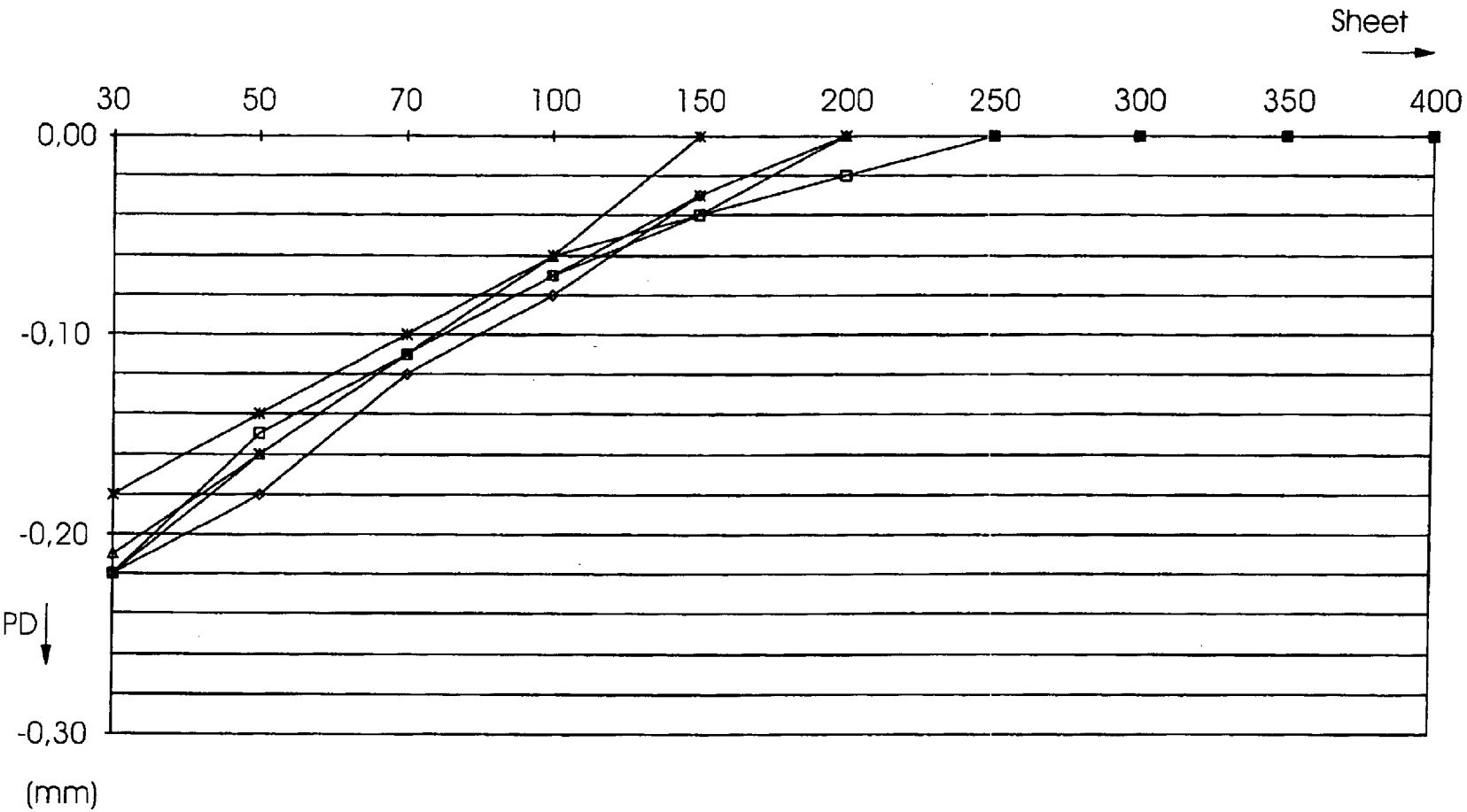
FIG. 3 shows the repeated detection of the misregistration of a selected printing unit in the calibration phase.

Accordingly, as shown in FIG. 3, in a calibration phase for each printing unit the register of first printing unit 4 with respect to subsequent printing units 5, 6, 7 is determined using a measuring device or by visual inspection. Misalignment PD is measured at multiple interpolation points of the pattern, for example at the 30th, 50th, 100th sheet, etc., relative to first printing unit 4. If correction of the position of the overall image on the sheet is needed, in addition the position of the color separation of the reference group, in this case first printing unit 4, may be determined relative to the outer edges of the sheet. In the calibration phase, for each individual printing unit multiple patterns of misregistration are measured and average misregistration is determined from the scattered measurement data. To this end, the misalignment data is supplied to controller 13, which determines register correction values Ki to correct the misregistration for each printing unit from the input data.

When printing resumes after a pause, register correction values Ki are applied through register adjustment motors 18, 19, 20, 21 of the individual printing units to the corresponding plate cylinders, in order to make adjustments. Thus from central controller 13 a corresponding compensation is made for the circumferential register, and in certain circumstances also for the lateral and diagonal (skew) registers, of the printing unit 4, 5, 6, 7 in question upon restart after a pause in printing, or a continuous change is made in the register settings through the sheet sequence after restart, so that the original steady-state final value of the register is reached in the printing phase.

The pattern of the misregistration between the interpolations known or determined in the calibration phase may be approximated in various ways. The pattern of the register error over the signature number is normally in the form of a hyperbolic function. It is advantageous if first printing unit 4 is used as the datum point, but using any of the other printing units is also possible. The compensation may, for example, be stored in controller 13 in the form of characteristic curves, which may be edited.

If despite the application of register correction values Ki following a pause in printing, misregistration still does occur, this may be detected automatically by suitable detectors and updated register correction values K'i may be determined from them. These corrected values K'i are then used upon a subsequent pause in printing to compensate for the remaining misregistration.

The register behavior following a pause in printing may also be detected as a function of the influencing variables of printer speed, paper, rubber blanket, ink, subject (coverage), washing agent for the rubber blanket, temperature and duration of the pause. The compensation may then be adapted to the specific order and the specific condition. The method may also be used for pauses in printing when the rubber blanket is not washed, although the changes in register will then be much smaller and less intrusive.

| List of reference notation | |
|---|---|
| 1 | Printing press |
| 2 | In-feed |
| 3 | Out-feed |
| 4, 5, 6, 7 | Printing units |
| 8 | Drive motor |
| 9 | Belt |
| 10 | Gear train |
| 11 | Incremental transducer |
| 12 | Motor regulator |
| 13 | Controller |
| 15 | Memory unit |
| 18, 19, 20, 21 | Register adjustment motors |
| 22a, 23a, 24a, 25a | Plate cylinder |
| 22b, 23b, 24b, 25b | Rubber blanket cylinder |
| 22c, 23c, 24c, 25c | Counterpressure cylinder |
| Ki | Register correction value |
| K'i | Updated register correction value |
| PD | Misregister |
| tU | Time of the pause |
| DW2/1 | Misalignment of the second printing unit relative to the first printing unit |
| DW3/1 | Misalignment of the third printing unit relative to the first printing unit |
| DW4/1 | Misalignment of the fourth printing unit relative to the first printing unit |

What is claimed is:

1. A method of compensating for misregistration during operation of a printing press, misregistration occurring in individual printing units being countered by register corrections, comprising the steps of:

during a calibration phase, determining a pattern of misregistration after a pause in printing over a plurality of sheets;

storing data as a function of the pattern of the misregistration in a memory unit; and applying register correction values to the printing press upon restart of a press run after a second pause in order to compensate for the misregistration, the register correction values being a function of the patter of misregistration.

2. The method as recited in claim 1 wherein in the calibration phase multiple patterns of misregistration are determined for each of the printing units and the register correction values are a function of an average of the multiple patterns.

3. The method as recited in claim 1 wherein the pattern of the misregistration is recorded at specific interpolations.

4. The method as recited in claim 3 wherein the pattern of the misregistration is approximated through a hyperbolic function and the misregistration values between the interpolations are interpolated or extrapolated using the hyperbolic function.

5. The method as recited in claim 1 wherein the register correction values are stored as a function of the parameters extant during the press run.

6. The method as recited in claim 5 wherein the parameters include at least one of temperature, subject, washing agent, paper class and ink type.

7. The method as recited in claim 1 wherein the compensation of the misregistration is started with a first printed sheet after the second pause.

8. The method as recited in claim 1 further detecting further misregistration occurring after the second pause despite application of the register correction values; determining updated register correction values from the further misregistration; and using the updated register correction values upon a subsequent pause in the press run to compensate for the further misregistration.

9. The method as recited in claim 1 wherein register the correction values are a function of a type of the second pause.

10. The method as recited in claim 9 wherein the type of the second pause is a pause for washing of the rubber blanket.

11. The method as recited in claim 1 wherein the registration correction values are a function of a duration of the second pause.

12. The method as recited in claim 1 wherein the printing press is a sheet-fed offset printing press.

* * * * *